US008966699B2

(12) United States Patent
Contardi

(10) Patent No.: US 8,966,699 B2
(45) Date of Patent: Mar. 3, 2015

(54) FLOOR WASHING-DRYING MACHINE WITH AUTOMATICALLY ORIENTING SCRAPING DEVICE

(75) Inventor: Leonardo Contardi, Guardamiglio (IT)

(73) Assignee: Nilfisk-Advance A/S, Brondby (DK)

( * ) Notice: Subject to any disclaimer, the term of this patent is extended or adjusted under 35 U.S.C. 154(b) by 204 days.

(21) Appl. No.: 13/820,776

(22) PCT Filed: Oct. 5, 2011

(86) PCT No.: PCT/EP2011/067403

§ 371 (c)(1),
(2), (4) Date: Mar. 5, 2013

(87) PCT Pub. No.: WO2012/049057

PCT Pub. Date: Apr. 19, 2012

(65) Prior Publication Data

US 2013/0160225 A1 Jun. 27, 2013

(30) Foreign Application Priority Data

Oct. 12, 2010 (IT) ..... PN2010A0059

(51) Int. Cl.

| | |
|---|---|
| ***A47L 11/283*** | (2006.01) |
| ***A47L 11/30*** | (2006.01) |
| ***A47L 11/282*** | (2006.01) |
| ***A47L 11/40*** | (2006.01) |
| *A47L 11/293* | (2006.01) |

(52) U.S. Cl.

CPC ..... *A47L 11/305* (2013.01); *A47L 11/282* (2013.01); *A47L 11/4044* (2013.01); *A47L 11/4058* (2013.01)

USPC ..... 15/50.1; 15/4; 15/98; 15/401; 15/369; 15/368; 15/355; 15/320; 15/49.1

(58) Field of Classification Search

CPC ... A47L 11/283; A47L 11/305; A47L 11/282; A47L 11/293

USPC ..... 15/49.1, 50.1, 98, 4, 401, 320, 369, 15/355, 354, 340.3, 368

See application file for complete search history.

(56) References Cited

U.S. PATENT DOCUMENTS

| | | | | |
|---|---|---|---|---|
| 4,805,256 | A * | 2/1989 | Mason et al. | 15/320 |
| 5,623,743 | A * | 4/1997 | Burgoon et al. | 15/320 |
| 2005/0251937 | A1 | 11/2005 | Ruffo | |
| 2009/0031521 | A1 | 2/2009 | Crivellaro | |
| 2011/0030163 | A1 * | 2/2011 | Tucker et al. | 15/320 |

FOREIGN PATENT DOCUMENTS

| | | |
|---|---|---|
| EP | 1 595 487 | 11/2005 |
| EP | 2 022 383 | 2/2009 |
| EP | 2 248 455 | 11/2010 |

OTHER PUBLICATIONS

International Search Report Issued Feb. 14, 2012 in PCT/EP11/67403 Filed Oct. 5, 2011.

* cited by examiner

*Primary Examiner* — Mark Spisich
*Assistant Examiner* — Andrew A Horton
(74) *Attorney, Agent, or Firm* — Oblon, McClelland, Maier & Neustadt, L.L.P.

(57) ABSTRACT

A floor washing-drying machine including a scraping device that is capable of automatic orientation. The scraping device follows changes of direction of the machine by a simple and effective orienting mechanism so as to wipe all the surface washed by a washing mechanism, without leaving any wet portions on the surface. An idle mode mechanism is achieved by a bushing to which the scraping device is connected. The bushing is mounted in an idle and axially slidable mode on the brush rotation shaft.

10 Claims, 9 Drawing Sheets

FLOOR WASHING-DRYING MACHINE WITH AUTOMATICALLY ORIENTING SCRAPING DEVICE

TECHNICAL FIELD OF INVENTION

The present invention refers to a floor washing-drying machine provided with a scraping device that is capable of automatically orienting itself. In particular, the scraping device follows the changes in direction of the machine by means of a simple and effective orienting mechanism so as to wipe all the surface washed by washing means, without leaving any wet portions on said surface.

PRIOR ART

Various types of floor washing-drying machines are known. One type of said machines includes a machine body that encloses a motor for driving one or more circular brushes suitable to scrub a surface to be cleaned, dispensing means for a cleaning liquid with a relative holding tank, suction means to remove the cleaning liquid after it has been rubbed on said surface, and a relative collecting tank. The machine also includes a frame supporting the machine body and allowing the movements of the same on suitable wheels. A steering bar is connected to the machine body for driving and controlling the same machine.

In particular, a device termed head is connected to the lower portion of the frame and supports in rotation one or more disk-shaped brushes. In addition, means for collecting the soiled cleaning liquid are located in the lower part of the machine and behind the brushes, seen in the direction of forward movement of the machine itself, said means being separate from or integral with said head. Usually, the collecting means comprise a scraping device suitable to scrub the surface in order to remove the soiled liquid and a liquid suction chamber operatively associated therewith.

The scraping device is generally formed by a support on which is installed one or more scraping strips or blades that elastically and slidingly engage the surface of a floor. Such blades extend rearward from the brushes, with respect to the direction of travel, in a straight or curved manner, with a wiping front that is substantially perpendicular to the forward direction of the machine and such as to wipe all the wetted and brushed surface. On the support is also installed the suction chamber, that consists generally of a narrow longitudinal aperture adjacent to the blades or is defined by a space delimited by two such blades.

During the operation of the machine, the brushes are rotated to brush the floor on which the cleaning liquid has been poured. With the forward movement of the machine, the scraping blades collect or wipe the cleaning liquid scrubbed by the brushes on the floor.

If such forward movement is in a straight line, the blades are capable of scrubbing the surface in the best manner, since they cover substantially all the treated floor surface.

On the other hand, if during the forward movement the machine makes a rather tight turn, the blades are not capable of completely covering the surface wetted by the washing liquid. In fact, when the machine is being swerved, the portion of surface treated by the rotating circular brushes is larger than the surface covered by the blades.

As a result, some strips on the floor remain wet or it is necessary to go over them again to make sure that the wiping is carried out properly.

To remedy this problem, the machine can be equipped with blades that extend farther than the extension or diameter of the brushes. This solution is, however, cumbersome since the blades extend outward considerably from the body of the machine.

Or else, the machine can be equipped with blades in the shape of an arc that extends so as to cover more than half of the circumference of the brushes. In this, as in the previous case, it is also necessary to equip the machine with powerful suction means because the surface to be vacuumed becomes very large, with a consequent cluttering of spaces in the machine body and a greater energy consumption.

Moreover, it must be considered that in the movement in reverse, the above-mentioned drawback cannot be avoided. Likewise, in the case of cramped spaces, it is not possible to manoeuvre so as to make a repeat pass over any portions of surface that are still wet. A typical example is found at the corners in a room.

SUMMARY OF INVENTION

The technical problem at the basis of the present invention is, therefore, to provide a floor washing-drying machine that is capable of scrubbing the surface of floors in the best manner both during a straight-line travel and in curves, as well as, in particular, during travel in reverse, particularly when manoeuvring spaces are limited.

This problem is solved by a floor washing-drying machine comprising a compact scrubbing device that can be automatically orientated at any moment in the direction that makes it possible to wipe all the surface treated by the brushes.

BRIEF DESCRIPTION OF THE DRAWINGS

Further characteristics and the advantages of the floor washing-drying machine of the invention will become more evident from the following description of an embodiment given by way of non-limiting example, wherein.

DETAILED DESCRIPTION OF THE INVENTION

Figure 1:
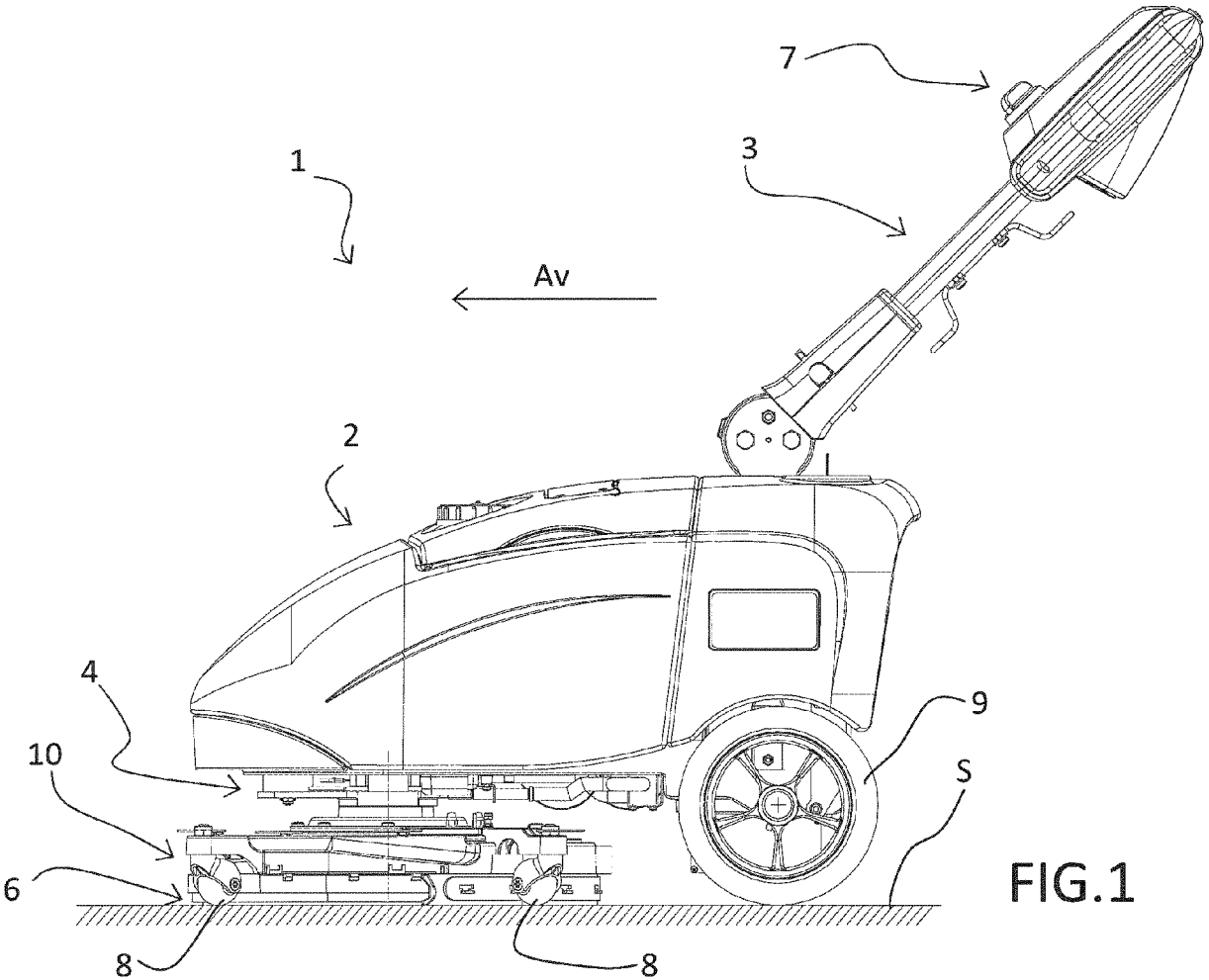
FIG. 1 is a side view of a floor washing-drying machine according to the invention during its forward operation.

In FIG. 1, reference number 1 indicates in general a floor washing-drying machine. The floor washing-drying machine 1 includes a machine body 2, a steering bar 3 and a support frame 4.

The machine body 2 mainly encloses a motor 5 (shown in FIGS. 2 and 6) that drives one or more circular brushes 6 suitable to scrub a surface of a floor S to be cleaned, means for dispensing a cleaning liquid with the relative holding tank (not shown), suction means to remove the cleaning liquid after it has been rubbed on said surface, and a relative collecting tank (not shown), and storage batteries. The cleaning fluid dispensing means, the suction means for removing the soiled cleaning liquid and the storage batteries will not be described in detail because they are all of conventional type.

The steering bar 3 is fastened to the machine body in a known manner and fulfils the function of steering the machine. In addition, it may include for example, at the handgrip, control devices 7 to drive and control the operation of the machine. These devices are also widely known to a person skilled in the field.

The support frame 4, on which the machine body rests and is allowed to perform its movements, includes front wheels 8 and rear wheels 9. In particular, the front portion of the frame 4, with respect to the forward direction of travel, has a head 10 that includes one or more rotating disk-shaped brushes 6.

Figure 2:
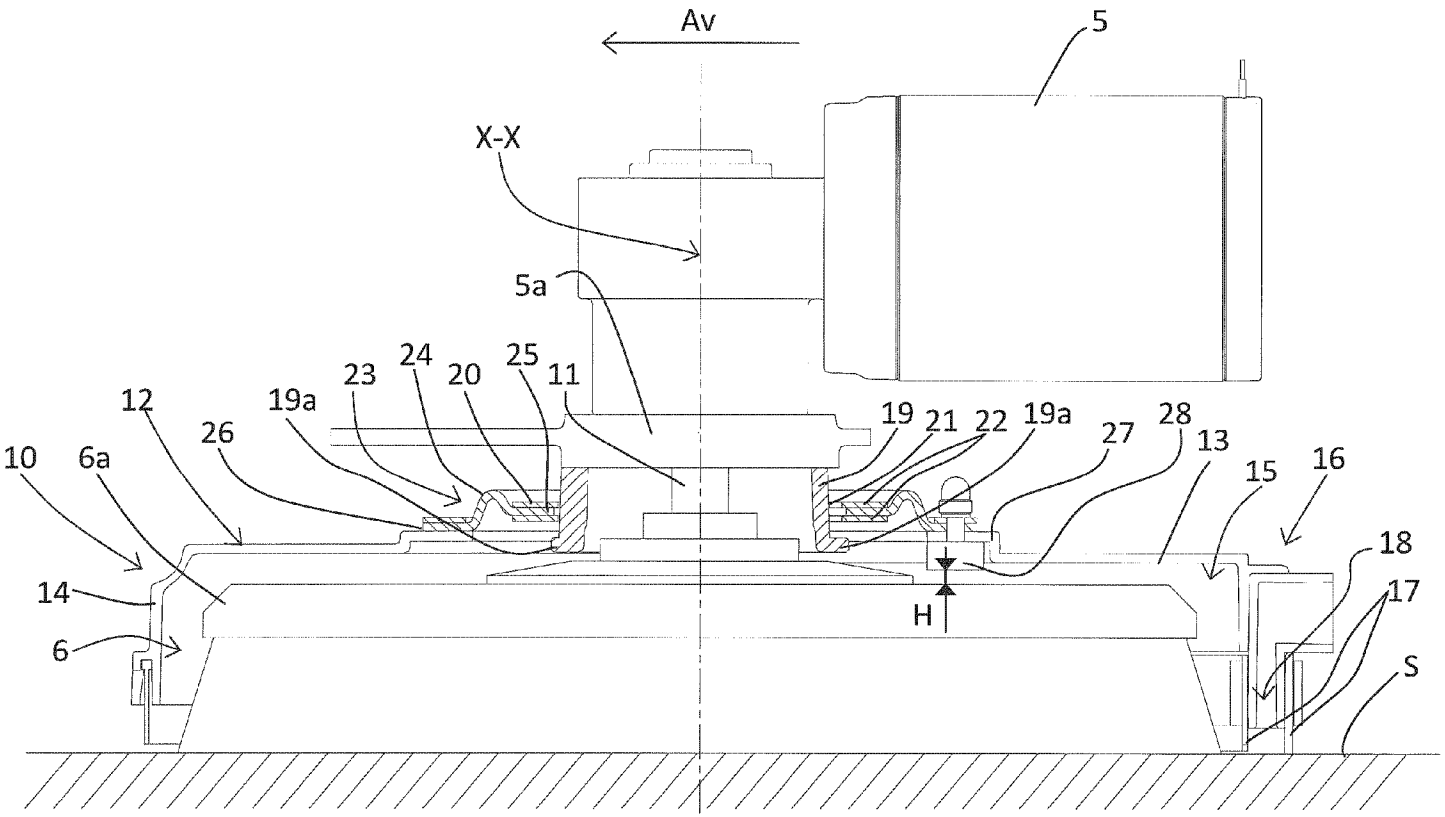
FIG. 2 is a side view in partial cross section of a head of the machine of FIG. 1.
Figure 6:
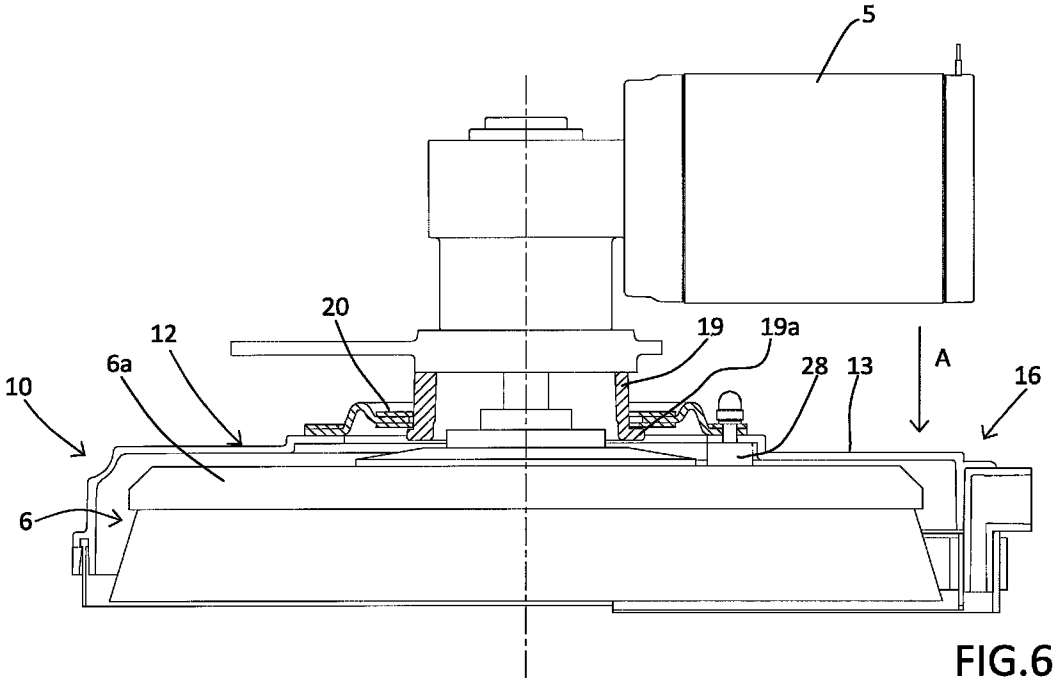
FIG. 6 is a side view in partial cross section of the head of FIG. 2 when raised.

With particular reference to the embodiment of FIGS. 2 and 6, the motor 5 is preferably an electric motor of conventional type, which therefore will not be described in detail. In general, the electric motor 5 includes a stator associated with a rotor (not shown). The rotor is in turn connected to a shaft (not shown) that rotates a disk-shaped brush 6. The rotating shaft is mounted on a motor support 5*a* in a position substantially normal to the floor along an axis X-X, when the machine is in operation. The motor support 5*a* is, in turn, fastened to the frame 4. Further, a pin 11 supporting the brush 6 is keyed to the rotating shaft in a completely conventional manner.

The head 10 is preferably made up of a disk-shaped support or shell 12 provided with a circular and substantially flat end wall 13 and an annular wall 14 that extends substantially perpendicular from the external edge of the end wall 13 so as to create a seat 15 suitable to receive the brush 6.

In agreement with the example of the embodiment, the head 10 includes a scraping device 16 preferably anchored to the side wall 14 of the shell 12 and positioned in the rear of the brush 6 with respect to the front of the machine. The scraping device 16 extends along an arc such as to substantially cover half or the circumference of the shell itself (as shown in FIGS. 3, 4, 7, 8).

Further, with reference to FIGS. 2 and 6, said device may include two parallel wiping strips or blades 17 separated from each other by a gap suitable to create a suction chamber 18. The suction chamber 18 is then connected to suction means (not shown) to remove the soiled cleaning liquid, after the liquid has been rubbed on a floor S by the brush 6, and to collect it in a suitable collecting container (not shown) housed, as already explained, within the machine body 2.

Advantageously, the head 10 is connected to the motor support 5*a* by means of an idle connection slidable along the axis X-X.

Preferably, a substantially cylindrical, hollow guide 19 is fastened to the lower portion of the motor support 5*a* coaxially to a pin 11 of the brush 6 keyed on the rotation shaft. The guide 19 includes an end 19*a* facing the floor S and with a flanged edge bent toward the outside of the same guide. Said end has the function of avoiding an accidental withdrawal of the head from the machine, especially when, as will be described, the head is raised. A bushing 20 is then slipped externally and coaxially onto the guide 19 so as to create said idle connection. In particular, between the bushing 20 and the guide 19 there is an annular space 21 that makes it possible to have the idle connection, that is, the bushing 20 is free to rotate around the guide 19, which instead is fastened to the motor support 5*a*. In addition, as shown in FIG. 2, when the head 10 rests on the floor S, the bushing 20 is axially separated from said flanged end 19*a* of the brush rotation guide 19.

Moreover, the simultaneous slidable connection along the axis X-X of rotation of the guide 19 is preferably achieved by providing an empty space H between the brush 6 and the end wall 13 of the shell 12 on the head 10. This space H is determined by the greater height of the side wall 14 of the shell 12 on the head from the floor compared to the height of the brush 6, when the head 10 rests on a floor S.

In the example of the embodiment of the invention, in fact, the bushing 20 is made up of two rings 22 connected with the end wall 13 of the shell 12 of the head 10 by means of a spring element 23 or annular connecting gasket provided with a rib 24 or elastic fold. The rib 24 divides the plate into an upper, axial portion 25 sandwiched between said rings 22 and a lower, radial portion 26 for the connection with the bottom 13. Preferably, the end wall 13 too can have a step 27 suitable, for example, for creating a seat for receiving and fastening a friction-engagement element, as explained later.

Obviously, the bush 20 can be made integral with the end wall 13 of the head 10, and the side wall 14 of the head may have a height that is greater than the height of the brush 6, without the above-mentioned annular connecting gasket 23 and/or step 27 of the end wall 13.

Preferably, moreover, a friction-engaging element 28 is fastened to the internal surface of the end wall 13 of the shell 12 of the head 10. This element can be represented by an annular sector of synthetic rubber having mechanical and surface characteristics capable of engaging the rotating surface of the plate 6*a* that holds the brush bristles to allow the rotating head 10 to be towed, as will be explained in detail later.

The engaging element 28 can also be represented by any other mechanism that allows the head 10 to engage with the brush 6 when the two components come into mutual contact.

Figure 2A:
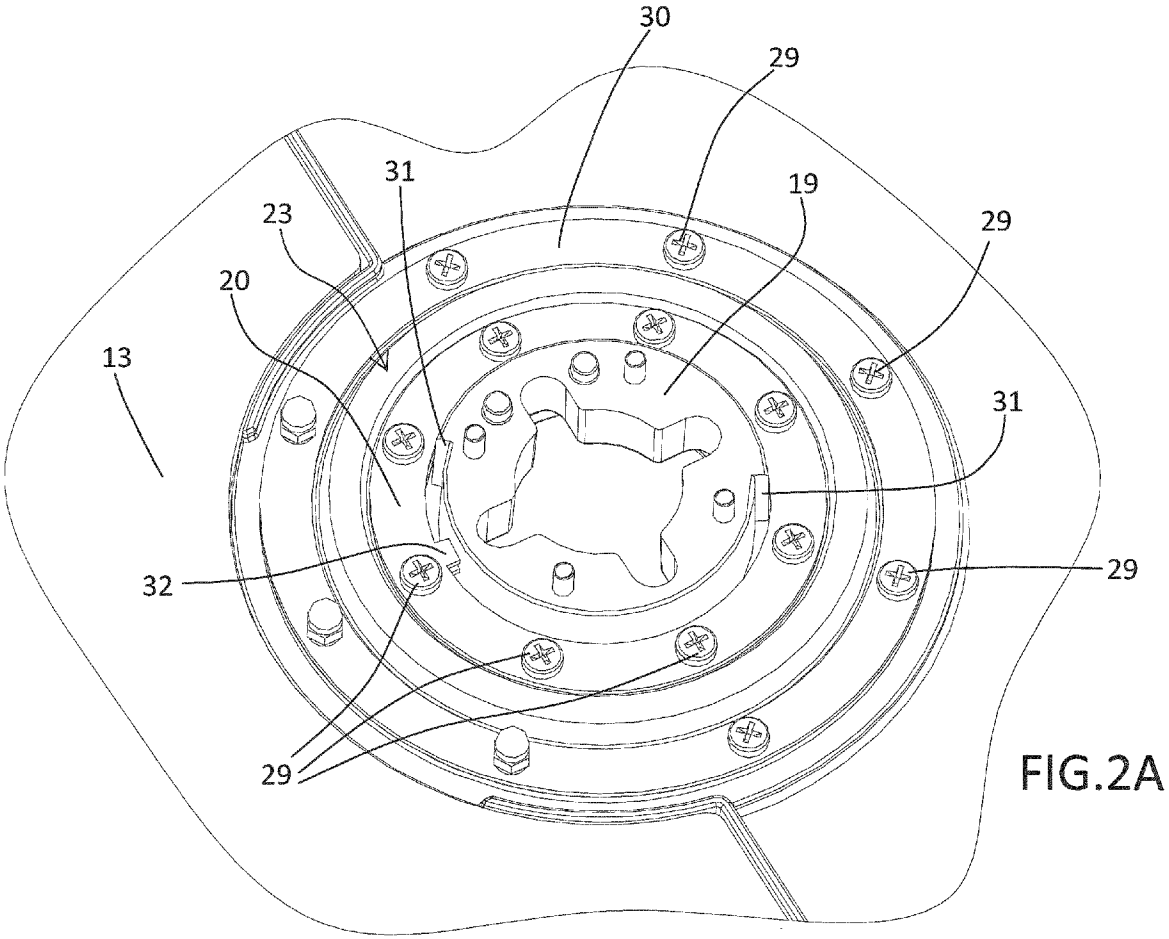
FIG. 2A is an axonometric view from above of a detail of the head of the machine of the invention.

FIG. 2A illustrates a detail of the head 10. The view of the detail from above does not include the motor unit 5 and the relative support 5*a*. As can be seen, from the centre outward the head 12 is provided concentrically with the guide 19, the bushing 20, the gasket 23 and the end portion 13. Preferably, the rings 22 of the bushing 20 and the upper, axial portion 25 of the gasket 23 are sandwiched by means of conventional fastening bolts 29. Likewise, the lower, radial portion 26 can be fastened to the end portion 13 between an annular plate 30 and said end portion 13, again with the relative bolts 29.

Advantageously, the external wall of the guide 19 includes first travel-end stop elements 31 suitable to cooperate with second travel-end or stop elements 32 located on the inside wall of said bushing 20.

In particular, in the exemplified embodiment, the external wall of the guide 19 includes two abutments 31 or ledges against which two teeth 32, one for each of the rings 22 of the bushing 20, can strike alternately, as will be explained later.

The operation of the floor washing-drying machine according to the present invention will now be described.

Figure 3:
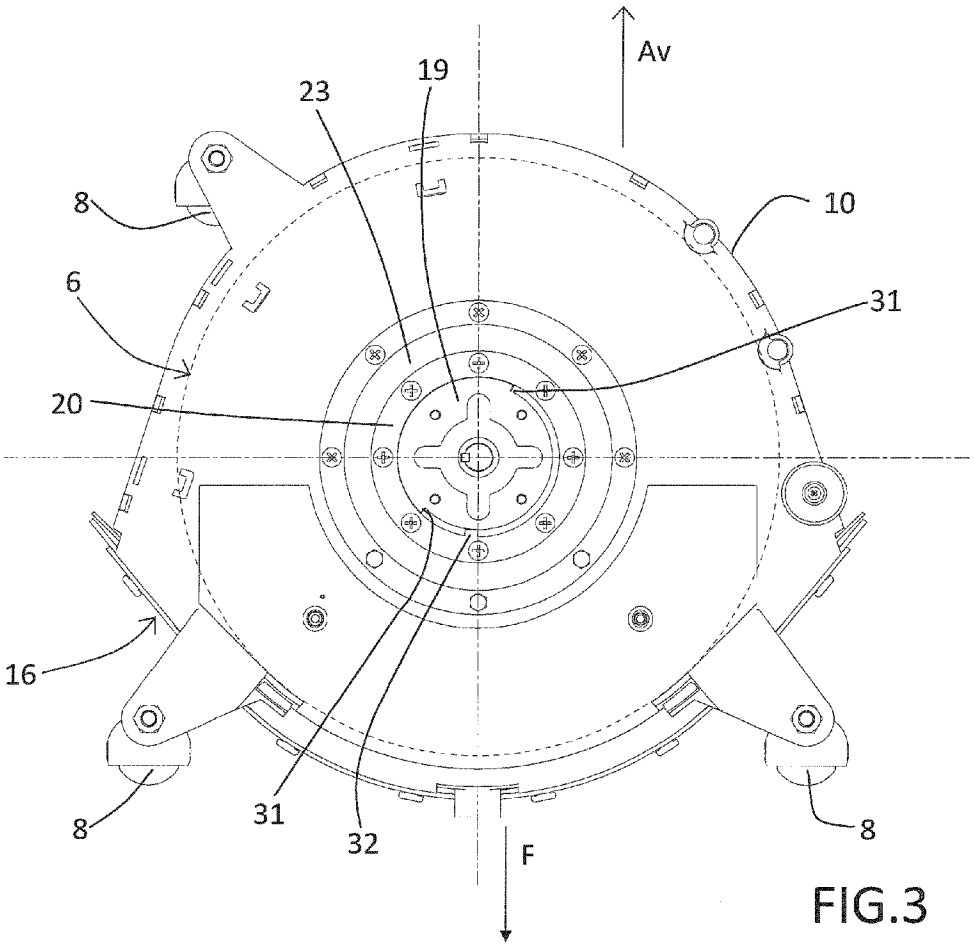
FIG. 3 is a schematic view from above of the head of FIG. 2 during its forward operation.
Figure 4:
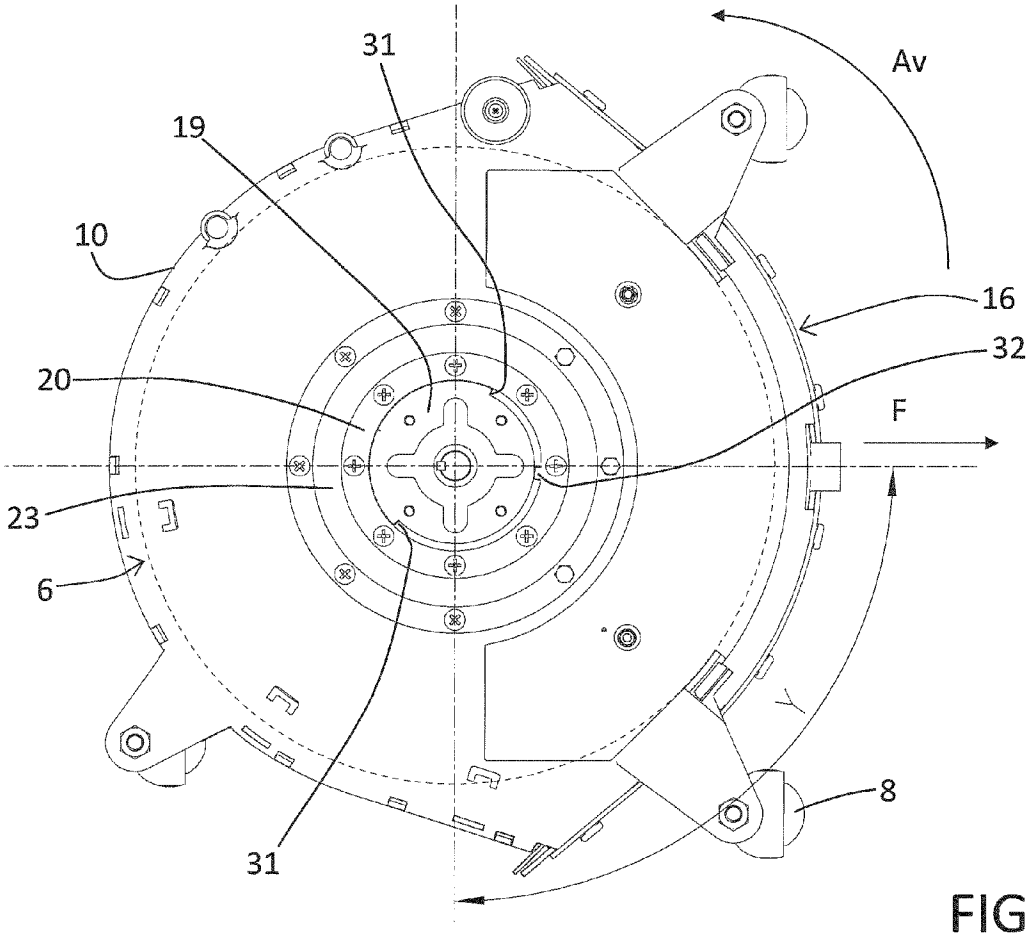
FIG. 4 is a schematic view from above of the head of FIG. 2 while performing a turn.

A side a top view, respectively, of the head 10 during the forward travel of the washing-drying machine 2, is shown with reference to FIGS. 2 and 3. The arrow marked Av shows the forward direction of travel of the machine 2. The arrow marked F indicates the sense and direction of the friction force acting on the scraping device 16. The broken line outlines the brush 6.

As shown in FIG. 2, the head 10 with the brush 6 and the scraping device 16 rest on the ground and there is no axial contact between the brush and the head or the scraping device, thanks to the gap H that physically separates said components. In its forward movement, that is, in the direction shown by the arrow Av, the scraping device 16 remains in a position behind the brush 6 due to the effect of the frictional force F exercised by the floor S and also in part by the suction force exercised by the suction means at the suction chamber 18 (FIG. 3). In other words, the scraping device 16 is located downstream from the brush 6. Moreover, the bushing 20 allows the head 10 to idle with respect to the rotating brush 6.

When a turn is performed even with a very tight steering angle (arrow Y of FIG. 4), thanks to the above idling connection, the head 10 rotates under the influence of the frictional force F exerted by the floor so as to position the scraping device 16 generally perpendicular to the direction of forward movement Av. In other words, the head and consequently the scraping device remain positioned behind the brush 6 or downstream of the brush, following the changes in the path of the machine 2.

Figure 5:
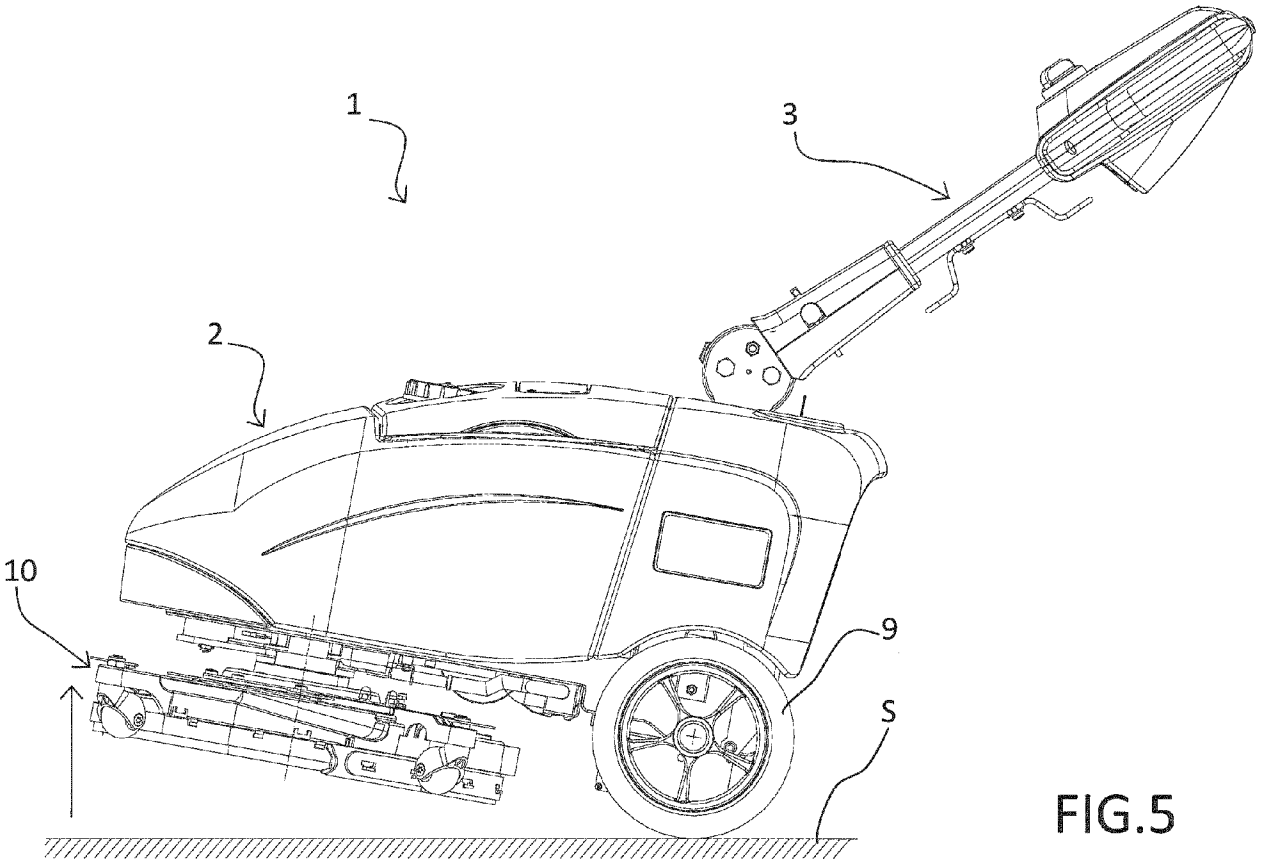
FIG. 5 is a side view of the machine of FIG. 1 with the head raised.

If it becomes necessary to perform an operation in reverse as in the case of the corners in a room, the machine 2, as shown in FIG. 5, can be lifted by pushing the steering bar 3 toward the floor S. The rear wheels 9 act as a pivot and the head 10 is raised from the floor S, as shown by the arrow. Consequently, both the brush 6 and the scraping device 16 are detached from the floor S. Thus, due to the force of gravity and thanks to the free axial connection explained above, the head 10 is lowered, as shown by the arrow A, until the internal surface of the end portion 13 of the head 10 contacts the plate 6*a* that carries the brush bristles 6. At the same time, the friction-engaging element 28 contacts the plate 6*a*. In the preferred embodiment, the distance H is determined between said element 28 and the plate 6*a*, as said element projects slightly below the end portion 13. Alternatively, the element 28 can be integrated in the same end portion.

Now, since the brush 6 is in rotation, thanks to said frictional contact, the head 10 and the scraping device 16 are also driven into rotation in the same direction. In particular, as shown in FIG. 6, the head 10 rotates from the initial position by an angle X smaller than 180°, for example 175°-140°, preferably 165°-145°, and stops when it encounters the stop elements 31 and 32. It is evident that the scraping device 16 is now positioned in front of the brush 6, with reference to the front end of the machine 2.

At this point, the head 10 can be lowered again so that both the brush 6 and the scraping device 16 touch the floor S. Due to said axial connection between the guide 19 and the bushing 20, the head is automatically raised with respect to the brush 6 and re-establishes the space H between these two components. As a consequence, the head 10 returns to the idle state with respect to the brush 6 in rotation.

Figure 7:
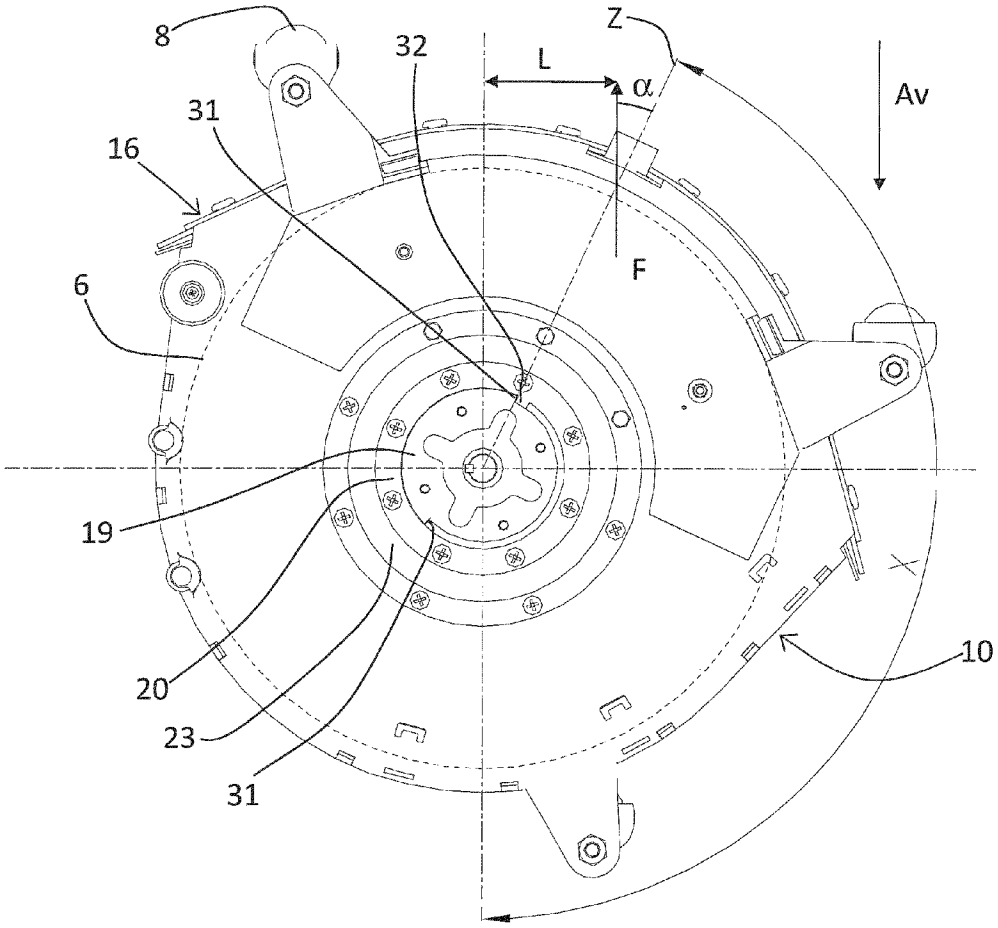
FIG. 7 is a schematic view from above of the head of FIG. 2 when it is moving in reverse.

In this position, it is possible to perform the reverse travel operation indicated by the arrow Av, as shown in FIG. 7, during which the frictional force F between the floor S and the blades 17 of the scraping device 16, and partly also the suction force of the suction chamber 18, keeps the head 10 and the scraping device 16 turned in a direction opposite to the position of forward travel. It is hypothesized, without being bound to any theory, that the barycentre of the forces acting upon the scraping device 16 is located along a radius Z of the head 10, offset at an angle $\alpha$ with respect to the direction of the force F. This results in the creation of a lever arm L or a resultant of the forces acting upon the head 10 such that the head itself remains in position.

It is evident, therefore, that the action of the blades 17 of the scraping device 16 is optimized during the travel movement in reverse. In fact, since the blades 17 are at the rear of the brush 6 with respect to the backward movement, in other words downstream of the brush, they can wipe completely the surface of the floor S treated by the brush without leaving any wet portions.

Once the reverse operation is completed, the initial condition of forward travel operation can be restored very simply and automatically. In fact, it is sufficient to reverse the direction of thrust on the machine, that is, simply resume the forward movement.

Figure 8:
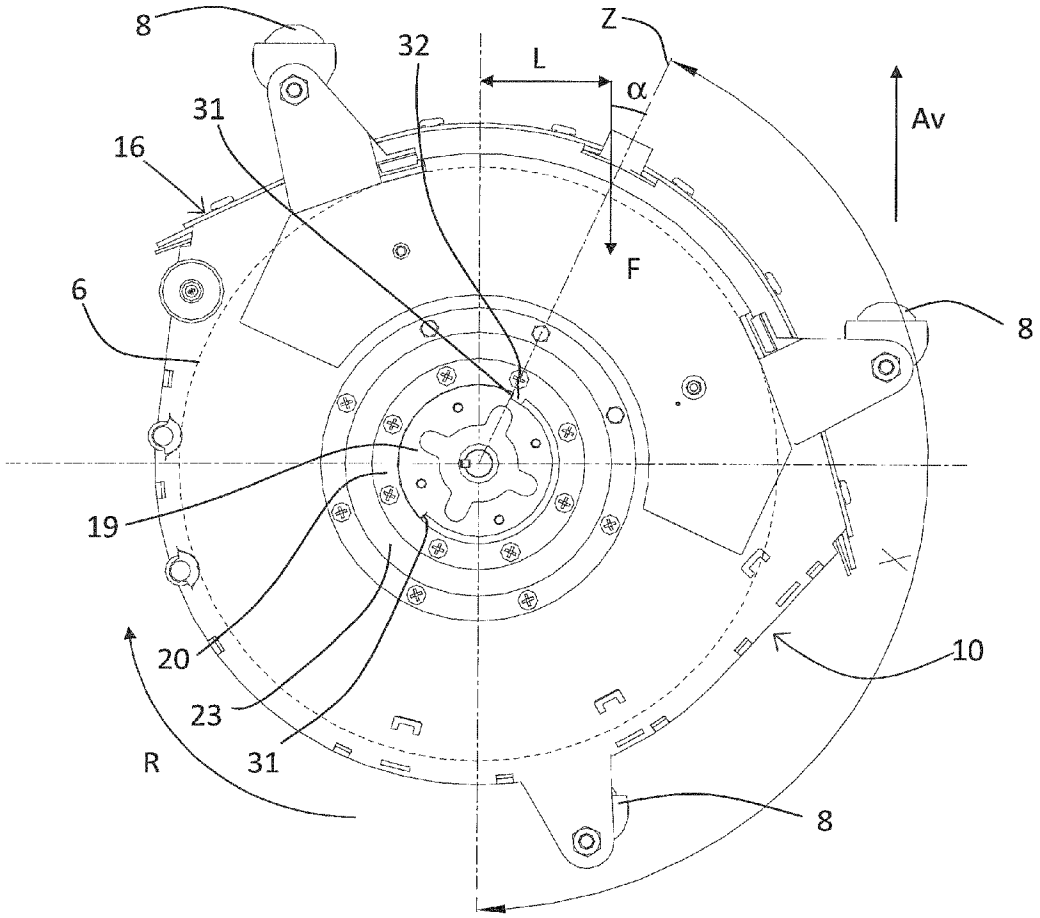
FIG. 8 is a schematic view from above of the head of FIG. 2 in the initial phase of return to forward movement.

As shown in FIG. 8, with this operation the direction of the frictional force F and of travel Av are reversed. In this new condition, since the head is rotated by less than 180°, as previously explained, from the initial forward travel position, and thanks to the idle connection mentioned above, the resultant of the forces causes the head 10 to rotate in a reverse direction with respect to the previous direction of rotation (arrow R), returning the scraping device 16 to the rear of the brush 6 with respect to the forward direction of travel Av.

As described to this point, it is thus evident that the problems reported in the introductory part of the present description have been solved and important advantages have been achieved.

First of all, the floor washing-drying machine 1 of the invention is capable of wiping all the treated surface of the floor without leaving any wet areas when performing tight turns or operations in reverse.

In addition, the technical characteristics used to achieve the above objective have been studied and accomplished without complicated devices that could alter the proper operation of the machine or cause irksome encumbrances, or burdensome production costs.

In particular, there is no need to have complicated mechanisms to obtain the rotation of the head 10, as this is provided automatically by means of a bushing 20 that makes it possible, on one hand, to use the frictional forces between the scraping device 16 and the floor S and, on the other hand, to use the rotation of the brush 6 when wishing to perform a reverse operation.

It is not necessary to use oversize scraping devices, or very powerful suction means, to cover all the treated surface.

Further variants and modifications of the floor washing-drying machine of the present invention can be implemented by a person skilled in the field without departing from the patent protection as defined by the accompanying claims.

For example, the machine can be of the type with driver on board. In this case, a manual or power-driven mechanism can be provided to lift the head when it is necessary to operate in reverse.

Further, the scraping device 16 can be simplified by predisposing a single blade 17 or, in case of particular requirements, three blades as described in the Italian patent application PN2008A000006 by the same applicant. As an alternative or in combination, one of the blades of the scraping device can be provided with a strip-off portion to obtain a slot suitable to reduce noise, as described in the Italian patent application PN2006A000086 by the same applicant.

The stop elements can be eliminated and the locking of the rotation of the head can be achieved by the same suction duct for the soiled cleaning liquid. The duct can in fact have a predefined length such as to work as a sort of cable extending for a given length sufficient to allow the head to rotate of an angle smaller than 180°.

The scraping device 16 can alternatively be independent of the head 10. For example, it may be connected in idle mode to the guide 19 with a bushing similar to the one previously described through the interposition of a sort of one or more arms or supports separate from the head. Moreover, in this manner it may be positioned between the brush 6 and the side wall 14 of the shell 12 of the head 10. Alternatively, it may be positioned outside the shell 12. In any case, it will be provided with a bushing and a corresponding arm or support separate from the head, internally or externally. Obviously, the head may be fastened directly to the guide 19 in a non-rotatable manner.

The invention claimed is:

1. A floor washing-drying machine comprising:

a motor for driving a rotating shaft of one or more brushes adapted to scrub a washing liquid onto a floor;

a head including the brushes;

a scraping device to scrape the liquid after washing;

wherein the scraping device is mounted with respect to the rotating shaft in neutral, at an axial distance from the brushes and is maintained behind the brushes due to friction onto the floor, during forward and steering movements of the machine, while when the head is lifted up from the floor, due to gravity, the axial distance between brushes and scraping device becomes zero and the scraping device is engaged by means of rotation of the brushes to be positioned always behind the brushes, during backwards movement.

2. A floor washing-drying machine according to claim 1, wherein the scraping device is connected to a bush mounted in neutral with respect to the rotating shaft of the brushes.

3. A floor washing-drying machine according to claim 2, wherein the scraping device is connected to the bush by an elastic element or trimming.

4. A floor washing-drying machine according to claim 3, wherein the bush comprises two rings sandwiching an axial portion of the elastic element, a radial portion of the elastic element being instead connected to the scraping device.

5. A floor washing-drying machine according to claim 4, wherein the scraping device is connected to the radial portion of the elastic element through the head.

6. A floor washing-drying machine according to claim 2, further comprising a guide fixed to a support of the driving motor of the brushes and positioned between a pin of the brushes and the bush, the guide including an end toward the floor and with a flanged edge toward the exterior of a same guide to avoid an accidental slipping off of the head or of the scraping device.

7. A floor washing-drying machine according to claim 1, wherein the scraping device is mounted between the brushes and the head.

8. A floor washing-drying machine according to claim 1, wherein the scraping device is mounted separated and external to the head.

9. A floor washing-drying machine according to claim 1, further comprising a friction-engagement element between the scraping device and the brushes.

10. A floor washing-drying machine according to claim 1, further comprising first and second stop elements adapted to cooperate with each other to provide a stop of the rotation of the scraping device when the scraping device is engaged with the brushes.

* * * * *